US005809947A

United States Patent [19]

Thompson

[11] Patent Number: 5,809,947

[45] Date of Patent: Sep. 22, 1998

[54] PISTON VALVE

[76] Inventor: Kevin R. Thompson, 401 Harbor Pointe, Dunwoody, Ga. 30350

[21] Appl. No.: 919,040

[22] Filed: Aug. 27, 1997

[51] Int. Cl.[6] ..... F01L 11/00

[52] U.S. Cl. ..... 123/47 A

[58] Field of Search ..... 123/47 R, 47 A

[56] References Cited

U.S. PATENT DOCUMENTS

| | | | |
|---|---|---|---|
| 581,412 | 4/1897 | Capitaine | 123/255 |
| 931,319 | 8/1909 | Krotz | 123/47 A |
| 1,183,904 | 5/1916 | Palmer | 123/59.7 |
| 1,360,958 | 11/1920 | Kline | 123/54.4 |
| 1,402,866 | 1/1922 | Joy | 123/53.3 |
| 1,871,589 | 8/1932 | Dainton | 123/47 R |
| 2,431,859 | 12/1947 | Fisher | 123/47 A |
| 2,543,126 | 2/1951 | Philippovic | 123/46 SC |
| 3,177,853 | 4/1965 | Hendershot | 123/47 R |
| 3,855,979 | 12/1974 | Ottaway | 123/47 A |
| 4,112,882 | 9/1978 | Tews | 123/47 A |
| 4,156,410 | 5/1979 | Ramsey | 123/47 A |
| 4,250,844 | 2/1981 | Tews | 123/73 AV |
| 5,261,358 | 11/1993 | Rorke | 123/47 R |

*Primary Examiner*—David A. Okonsky
*Attorney, Agent, or Firm*—John L. James

[57] ABSTRACT

A valve is provided for a piston of a two stroke engine wherein the piston has a sidewall and top and bottom surfaces with the top surface having a first opening therein and a second opening extending between the top and bottom surfaces for receiving the valve, and wherein the piston has a plurality of pressure relief openings extending between the top and bottom surfaces. The valve comprises a valve plate positioned in the opening in the top surface overlaying the pressure relief openings with the valve plate having a central opening extending parallel to the sidewall. The valve plate is movable from a seated position covering the pressure relief openings to an unseated position exposing the pressure relief openings when pressure inside the piston exceeds a predetermined value. A retainer pin has an elongated body extending through the central opening in the valve plate, a head atop the retainer pin overlying the valve plate, and a hollow end portion flared radially outward against the bottom surface of the piston to limit upward movement of the retainer pin. The valve opens on the downstroke of the piston to relieve some of the crankcase pressure allowing the piston to descend with less resistance.

10 Claims, 4 Drawing Sheets

PISTON VALVE

FIELD OF THE INVENTION

The present invention relates generally to two stroke engines, and, more particularly, to a piston for a two stroke engine.

BACKGROUND OF THE INVENTION

In a two stroke engine, as the piston goes up it compresses the fuel-air charge above it, and simultaneously lowers pressure in the crankcase below it. As it nears top dead center, the piston skirt uncovers a port leading to the fuel-air supply and a charge enters the crankcase. At top dead center, the compressed cylinder charge is ignited and starts to drive the piston down. On nearing bottom dead center, it uncovers the exhaust port. As exhaust gases rush out, the fresh charge sweeps up into the cylinder. Going past bottom dead center, the piston again starts to rise closing the ports and compressing the cylinder charge as the cycle repeats. When the fresh charge sweeps into the cylinder, there is wasted air and fuel trapped in the hollow part of the piston. The trapped air and fuel is not at the top of the piston where it can be ignited causing part of the incoming charge to be lost thereby decreasing engine performance.

The charge is better distributed to the top of the piston when there are several passageways around the piston, but multiple passageways do not eliminate the problem of the entrapped fuel mixture. Prior pistons have included a charging passageway through its top surface with a pressure sensitive valve affixed to the top surface of the piston for preventing flow of a fresh charge through the charging passageway in the absence of a greater pressure differential caused by the intake charge against the undersurface of the pressure sensitive valve. The pressure sensitive valve deflects upwardly to provide a passage of a charge through the charging passageway in the presence of a sufficient pressure differential caused by the intake charge acting against the undersurface of the pressure sensitive valve, and the charging passageway and pressure sensitive valve coact to direct flow of the incoming charge toward the walls of the engine cylinder away from the exhaust. The valve is a flap valve constructed of a multiple layers of metal screwed to the top surface of the piston and the valve is used as an intake valve. Unfortunately, engine heat would tend to weaken the spring steel used in the valve and the high speed of the engine would cause the valve to fail. Accordingly, it will be appreciated that it would be highly desirable to have a valve that can withstand the high speed and temperatures of a two stroke engine.

SUMMARY OF THE INVENTION

The present invention is directed to overcoming one or more of the problems set forth above. Briefly summarized, according to one aspect of the invention, a valve is provided for a piston of a two stroke engine wherein the piston has a sidewall and top and bottom surfaces with the top surface having a first opening therein and a second opening extending between the top and bottom surfaces for receiving the valve, and wherein the piston has a plurality of pressure relief openings extending between the top and bottom surfaces. The valve comprises a valve plate positioned in the opening in the top surface overlaying the pressure relief openings with the valve plate having a central opening extending parallel to the sidewall. The valve plate is movable from a seated position covering the pressure relief openings to an unseated position exposing the pressure relief openings when pressure inside the piston exceeds a predetermined value. A retainer pin has an elongated body extending through the central opening in the valve plate, a head atop the retainer pin overlying the valve plate, and a hollow end portion flared radially outward against the bottom surface of the piston to limit upward movement of the retainer pin.

The valve acts as a pressure relief valve. On the downstroke of the piston, the valve opens to relieve crankcase pressure so that the pistons completes the downstroke with less resistance. Less resistance tends to increase performance in a two stroke engine.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
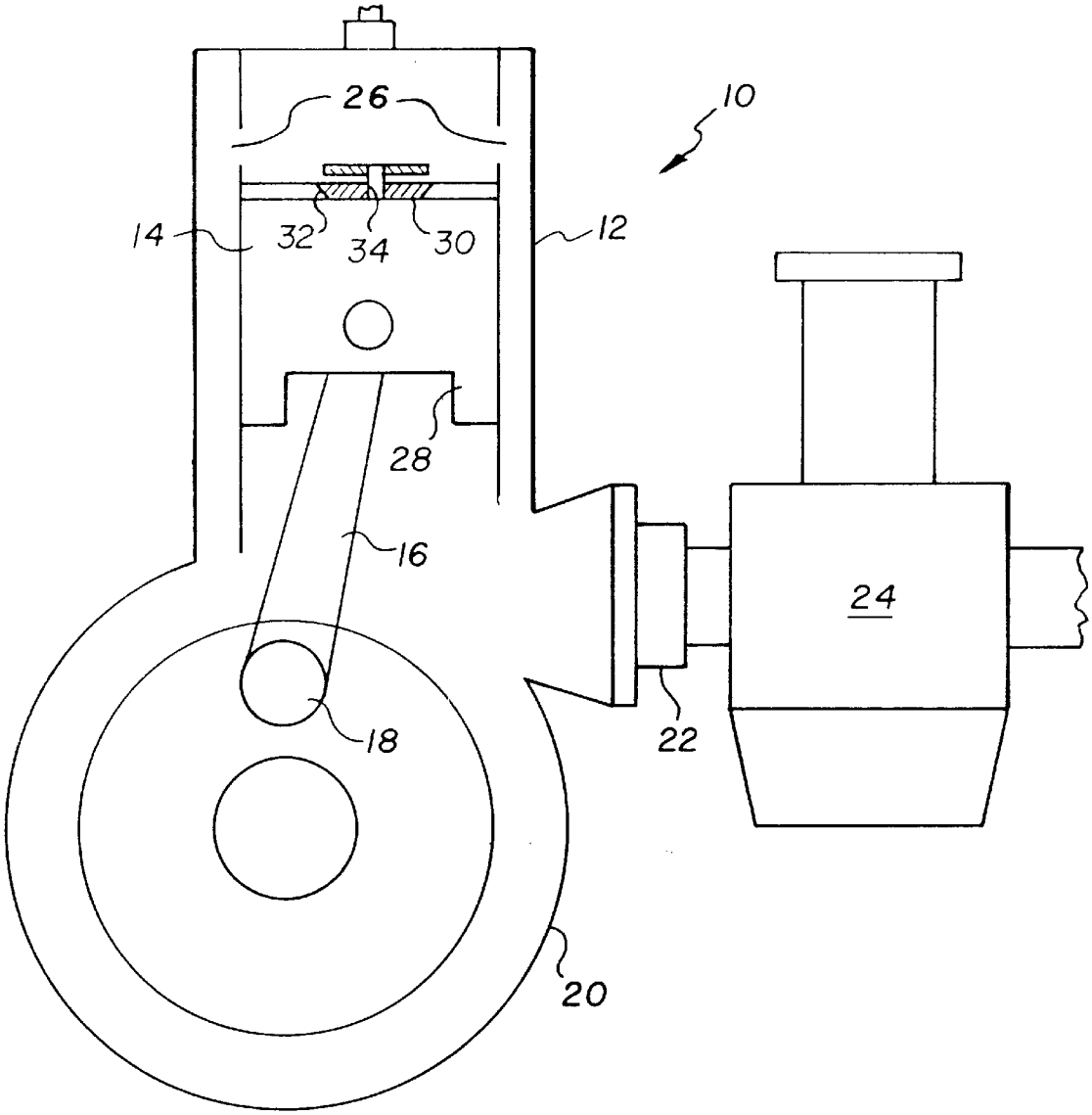
FIG. 1 is a diagrammatic view with portions shown in section of a preferred embodiment of a piston in a two stroke engine in its upstroke incorporating a piston valve according to the present invention.

Referring to FIGS. 1–5, a two stroke engine 10 has a cylinder 12 with a reciprocating piston 14 moving a piston rod 16 to turn a crankshaft 18 in crankcase 20. A reed valve 22 meters a fuel mixture to the crankcase 20 from a fuel source, such as carburetor 24. One or more passageways exist between the crankcase 20 and cylinder 12 to conduct the fuel mixture through intake ports 26 to the top side of the piston 14.

The piston 14 has a skirt or sidewall 28, a top surface with a first opening 30 bounded by a tapered shoulder 32, and a bottom surface with a second opening 34. The second opening 34 extends upward from the bottom surface to the first opening 30 in the top surface. Preferably, the second opening 34 is concentric with the first opening 30. The bottom surface also contains a number of pressure relief openings 36 extending upward to the first opening 30 in the top surface. There are preferably a plurality of pressure relief openings 36 equally spaced about the second opening 34. The diameter of the relief openings and number of openings is based upon the size of the engine.

A valve plate 40 is positioned in the first opening 30 in the top surface overlying the pressure relief openings 36 with an edge portion 38 tapered to match the taper of shoulder 32 so that valve plate 40 seats easily in the opening 30. It has a central opening 42 extending parallel to the sidewall 28. The valve plate 40 is moveable from a seated position at which it covers the pressure relief openings 36 to an unseated position at which it exposes the pressure relief openings 36. Valve plate 40 moves from the seated position to the unseated position when the pressure inside the piston exceeds a predetermined value which occurs during the piston downstroke. Valve plate 40 can also unseat due to inertia when the piston travels downward quickly.

A retainer pin 44 limits vertical movement of the valve plate 40. It has an elongated body that extends through the central opening 42 in the valve plate 40, and a head atop the body overlying the valve plate to retain the valve plate and limits its movement. A hollow distal end portion of the pin is flared radially outward against the bottom surface of the piston to limit upward movement of the retainer pin and thereby limit upward movement of the valve plate.

Figure 6:
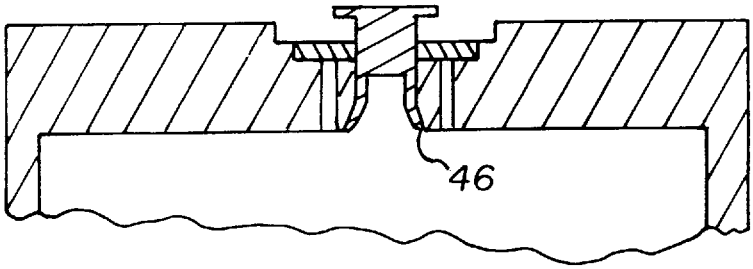
FIG. 6 is a sectional view of the piston similar to FIG. 5, but illustrating another preferred embodiment.

Referring now to FIG. 6, the second opening 34' extends downward from the first opening in the top surface toward the bottom surface. It has a shoulder 46 that joins the second opening with the bottom surface. Shoulder 46 may be tapered or could be a flat annular shoulder. A tapered shoulder facilitates flaring the end of the retaining pin with a tool during assembly. The hollow distal end portion of the retainer pin can be flared radially outward against the lower portion of the second opening of the piston to limit upward movement of the retainer pin and thereby limit upward movement of the valve plate.

Figure 2:
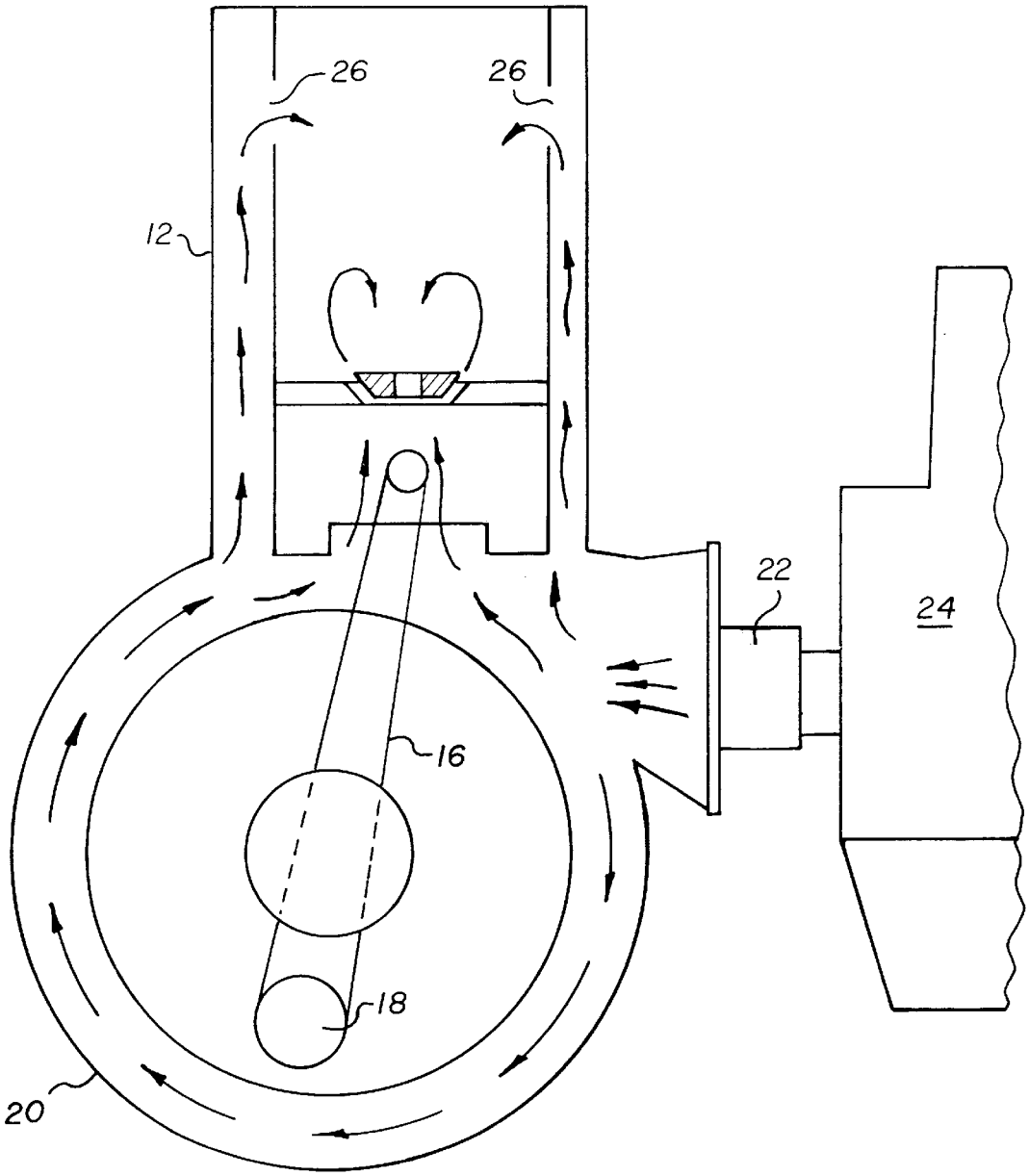
FIG. 2 is a diagrammatic view similar to FIG. 1 but illustrating the downstroke.
Figure 3:
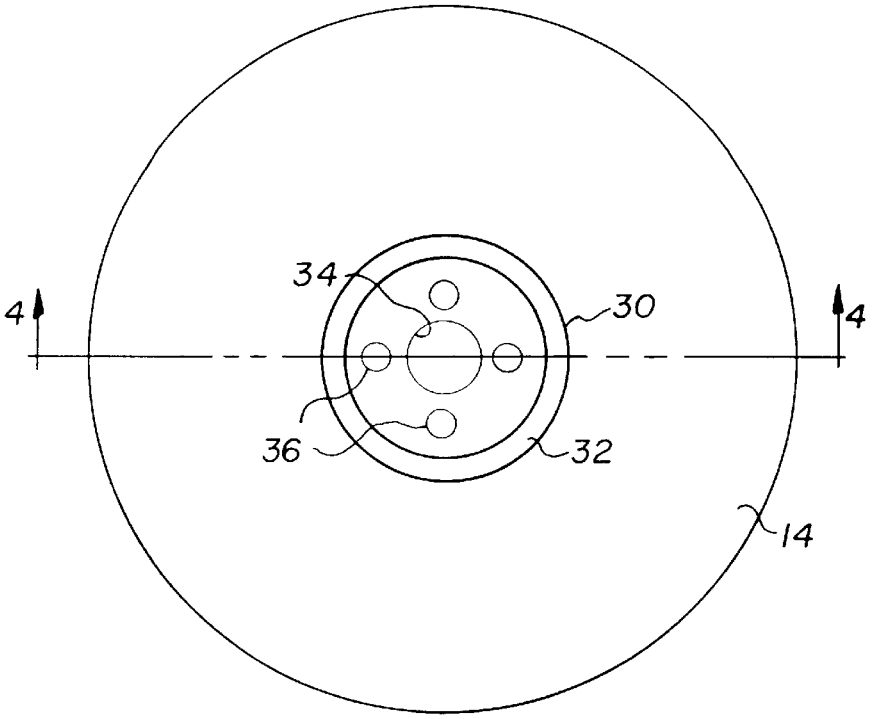
FIG. 3 is a top view of the piston of FIGS. 1 and 2 without the valve.
Figure 4:
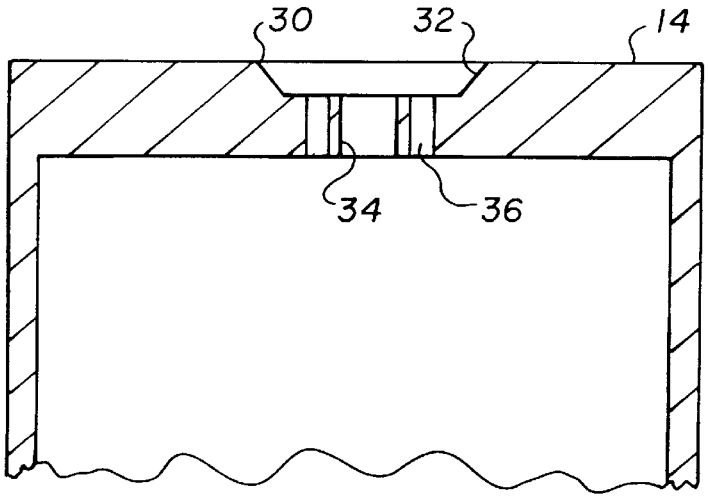
FIG. 4 is a sectional view of the piston of FIG. 3.
Figure 5:
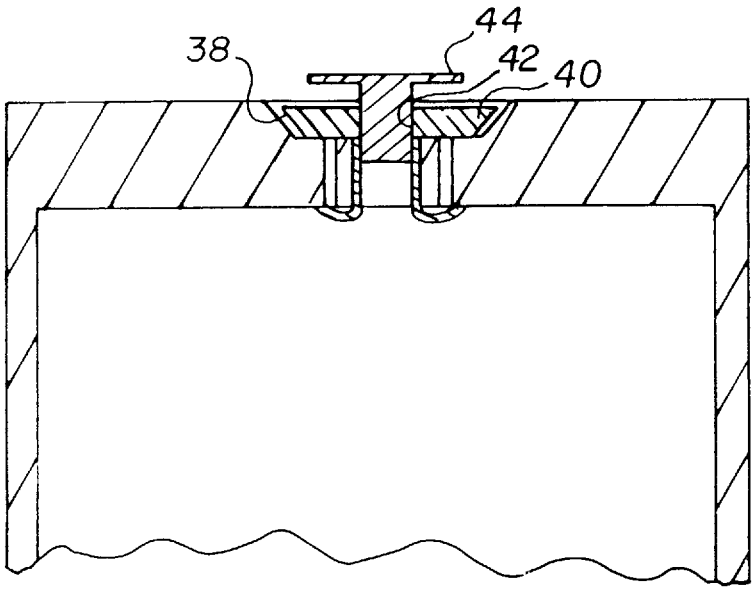
FIG. 5 is a sectional view of the piston of FIG. 3 with the valve installed.

Operation of the valve can be illustrated with reference to FIGS. 1–2. During the upstroke (FIG. 1), reed valve 22 meters an incoming fuel charge to the crankcase 20. The piston moves up toward top dead center closing the intake valves 26 and compressing a charge. The pressure relief valve is seated at this point. As the fuel charge ignites, the piston is forced downward trapping the incoming fuel charge and compressing it until the pressure relief valve unseats allowing a portion of the fuel charge to flow through the piston. The majority of the fuel charge flows around the piston through the intake ports as indicated by arrows in FIG. 2. On the downstroke, the air and fuel are forced downward into the crankcase. In a two stroke engine, when the air and fuel are forced into the crankcase, the air and fuel are pushed by the pressure of the piston moving downward into the intake ports that lead to the top of the piston.

It can now be appreciated that there has been presented a piston valve for a two cycle engine. The valve is a free floating valve retained by a center pin with a flared end portion. The valve is positioned in the center of the piston over equally spaced pressure relief holes. When seated, the valve covers the pressure relief holes to facilitate the compression stroke. As the piston descends, pressure in the crankcase unseats the valve after it passes the exhaust ports. This relieves some of the crankcase pressure and allows the piston to continue down to the bottom of the stroke and back to the point where compression begins with less resistance. The valve also acts as a pressure relief for the piston and crankcase. When the valve opens on the downstroke, it permits less constricted movement of the piston. This provides several advantages over standard solid pistons. For example, there can be a leaner mixture of air and fuel which increases power, and the piston moves with less resistance which increases power. Two stroke engines depend on engine rpm for power, therefore, the easier the movement of the piston, the easier the engine rpm is maintained. This improvement in the effort required to maintain engine rpm causes a shift in the power band of the engine. Two stroke engines are normally tuned to provide maximum torque in a specific rpm range. This improvement in effect causes the power to be more evenly distributed throughout the engine rpm range. When installed in a stock engine, the fuel mixture becomes richer due to less agitation of the mixture. Leaner carburetor jets can then be used which cause more cylinder pressure and therefore more power with less effort thereby relieving stress on engine components resulting in greater dependability.

The valve can be installed in an existing two stroke engine by machining the piston for the valve. The valve seat is machined at an appropriate angle and with appropriate dimensions based upon the size of the piston. The piston would have a hole machined in it for the retainer pin.

While the invention has been described with particular reference to the preferred embodiments, it will be understood by those skilled in the art that various changes may be made and equivalents may be substituted for elements of the preferred embodiments without departing from invention. In addition, many modifications may be made to adapt a particular situation and material to a teaching of the invention without departing from the essential teachings of the present invention. As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. A valve for a piston of a two stroke engine, said piston having sidewall and top and bottom surfaces with said top surface having first opening therein and a second opening extending between said top and bottom surfaces for receiving said valve, said piston having a plurality of pressure relief openings extending between said top and bottom surfaces, said valve comprising:

a valve plate positioned in said opening in said top surface overlaying said pressure relief openings, said valve plate having a central opening extending parallel to said sidewall, said valve plate being movable from a seated position covering said pressure relief openings to an unseated position exposing said pressure relief openings when pressure inside said piston exceeds a predetermined value; and a retainer pin having an elongated body extending through said central opening in said valve plate, a head atop said retainer pin overlying said valve plate, and a hollow end portion, said hollow end portion of said retainer pin being flared radially outward against said bottom surface of said piston to limit upward movement of said retainer pin.

2. A valve, as set forth in claim 1, wherein said first opening in said top surface of said piston has a tapered shoulder and said valve plate has a tapered edge portion for seating against said tapered shoulder.

3. A valve, as set forth in claim 1, wherein said pressure relief openings are equally spaced about said second opening that extends between said top and bottom surfaces of said piston.

4. A piston for a two stroke engine, comprising:

a sidewall;

a top surface defining a first opening;

a bottom surface defining a second opening extending upward to said first opening of said top surface, said second opening being concentric with said first opening, said bottom surface defining a plurality of pressure relief openings extending upward to said first opening of said top surface;

a valve plate positioned in said first opening in said top surface overlaying said pressure relief openings, said valve plate having a central opening extending parallel to said sidewall, said valve plate being movable from a seated position covering said pressure relief openings to an unseated position exposing said pressure relief openings when pressure inside said piston exceeds a predetermined value; and a retainer pin having an elongated body extending through said central opening in said valve plate, a head atop said retainer pin overlying said valve plate, and a hollow end portion flared radially outward against said bottom surface of said piston to limit upward movement of said retainer pin.

5. A valve, as set forth in claim 4, wherein said first opening in said top surface of said piston has a tapered shoulder and said valve plate has a tapered edge portion for seating against said tapered shoulder.

6. A valve, as set forth in claim 4, wherein said pressure relief openings are equally spaced about said second opening that extends between said top and bottom surfaces of said piston.

7. A piston for a two stroke engine, comprising:

a sidewall;

a top surface defining a first opening;

a bottom surface defining a second opening extending upward to said first opening of said top surface, said second opening being concentric with said first opening, said bottom surface defining a plurality of pressure relief openings extending upward to said first opening of said top surface;

a valve plate positioned in said first opening in said top surface overlaying said pressure relief openings, said valve plate having a central opening extending parallel to said sidewall, said valve plate being movable from a seated position covering said pressure relief openings to an unseated position exposing said pressure relief openings when pressure inside said piston exceeds a predetermined value; and a retainer pin having an elongated body extending through said central opening in said valve plate, a head atop said retainer pin overlying said valve plate, and a flared hollow end portion to limit upward movement of said retainer pin.

8. A valve, as set forth in claim 4, wherein said first opening in said top surface of said piston has a tapered shoulder and said valve plate has a tapered edge portion for seating against said tapered shoulder.

9. A valve, as set forth in claim 4, wherein said second opening in said bottom surface of said piston has a tapered shoulder and said flared hollow end portion engages said shoulder to limit upward movement of said pin.

10. A valve, as set forth in claim 4, wherein said pressure relief openings are equally spaced about said second opening that extends between said top and bottom surfaces of said piston.

* * * * *